US011148268B2

(12) United States Patent
Zhang

(10) Patent No.: US 11,148,268 B2
(45) Date of Patent: Oct. 19, 2021

(54) NAIL GUN

(71) Applicant: Huading Zhang, Taizhou (CN)

(72) Inventor: Huading Zhang, Taizhou (CN)

(73) Assignee: TAIZHOU DINGBA POWER TOOLS CO., LTD., Taizhou (CN)

( * ) Notice: Subject to any disclaimer, the term of this patent is extended or adjusted under 35 U.S.C. 154(b) by 284 days.

(21) Appl. No.: 16/550,173

(22) Filed: Aug. 24, 2019

(65) Prior Publication Data

US 2020/0061786 A1 Feb. 27, 2020

(30) Foreign Application Priority Data

Aug. 25, 2018 (CN) ..... 201821380316.8

(51) Int. Cl.
*B25C 1/04* (2006.01)

(52) U.S. Cl.
CPC ..... *B25C 1/047* (2013.01)

(58) Field of Classification Search
CPC ..... B25C 1/047; B25C 1/04–048; B25C 1/06; B25D 11/005; B25D 11/125; B25D 16/00; B25D 17/06; B25D 2211/068; B25D 2217/0026; B25D 2250/195
See application file for complete search history.

(56) References Cited

U.S. PATENT DOCUMENTS

2015/0129630 A1* 5/2015 Matsuno ..... B25C 1/047 227/130
2018/0043518 A1* 2/2018 Fukinuki ..... B25C 1/06
2018/0126528 A1* 5/2018 Pomeroy ..... B25C 1/06

FOREIGN PATENT DOCUMENTS

| | | | |
|---|---|---|---|
| CN | 1310740 | C | 4/2007 |
| CN | 101239458 | A | 8/2008 |
| CN | 201500965 | U | 6/2010 |
| CN | 204736190 | U | 11/2015 |
| CN | 205521220 | U | 8/2016 |
| CN | 205685265 | U | 11/2016 |
| CN | 106541367 | A | 3/2017 |
| CN | 105082062 | B | 10/2017 |

* cited by examiner

*Primary Examiner* — Anna K Kinsaul
*Assistant Examiner* — Veronica Martin
(74) *Attorney, Agent, or Firm* — Au Law Office, P.C.; Yiu F. Au

(57) ABSTRACT

A nail gun, comprising a first piston moveably disposed in the first cylinder, a second piston moveably disposed in the second cylinder, a driving ram, a pawl, a linear motion actuator electrically coupled to the control circuit unit, the linear motion actuator capable of driving the pawl to retain or release the driving ram. The adjustment button is configured to select a selected pressure rating of the pressure ratings, during the compression stroke, the pawl retains the driving ram, and the control circuit unit is configured to calculate a predetermined distance value of the second piston and control the second piston to move and form a predetermined compressing pressure in the second working chamber. The control circuit unit is configured to control the linear motion actuator to release the driving ram when the second piston moves the predetermined distance.

20 Claims, 13 Drawing Sheets

NAIL GUN

RELATED APPLICATIONS

This application claims benefit of Chinese Patent Application No. CN201821380316.8 filed Aug. 25, 2018.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention belongs to the technical field of nail guns and relates to a nail gun.

Related Art

The nail gun is a tool for continuously driving out nails, and is often used in the fields of construction and furniture production. There are many types of nail guns, including electric nail guns, pneumatic nail guns, gas nail guns, etc. Among them, pneumatic nail guns are widely used. Most of the traditional pneumatic nail guns use an air pump to generate high air pressure to push the driving ram in the cylinder of the pneumatic nail gun and to allow the driving ram to be driven by the high pressure air to perform hammering motion, so that the nails in the cartridge clip are nailed into an object or the nails are shot out.

Although the conventional pneumatic nail guns can automatically drive out the nails, the structure of using air pump to generate air pressure to push the driving ram is cumbersome and cannot guarantee the continuous high efficiency of firing the driving ram.

In order to reduce the size and weight of the nail gun and to ensure that the nail gun can continuously and efficiently perform firing, intensive researches have been conducted, such as the nailer with the Chinese patent application number CN201520454838.8, which comprises a closed first cylinder, and a closed second cylinder disposed outside the first cylinder, a working chamber of the first cylinder and a working chamber of the second cylinder are in communication with each other, inside the first cylinder is provided with a first piston, the first piston is fixedly connected with a driving ram, and the driving ram has a limiter. The nailer further comprises a pawl, inside the second cylinder is provided with a second piston, and the second piston is driven by a motor to move reciprocatively between a first position and a second position of the second cylinder. When the second piston is at the first position, the first piston is moved inwardly and then the pawl is pawled with the limiter of the driving ram; and when the second piston is at the second position, the motor drives the pawl to disengage from the limiter.

The patent can drive the second piston to compress air through the motor, and actuate the pawl to unlock through the motor to achieve fast, continuous and high-efficient firing of the nails. However, since the patent unlocks the driving ram by the mechanical linkage between the motor and the pawl, it is difficult to change the unlock position once the linked unlock position is set, so that the driving ram can only be unlocked at one position to perform nailing after the nailer's production and design are finalized. Therefore, the force of the driving ram striking the nails is constant, it is difficult to adapt to a variety of occasions that require different striking forces of the driving ram, and the usage is more restrictive.

SUMMARY OF THE INVENTION

In view of the above problems in the prior art, one embodiment of the present invention provides a nail gun. The technical problem to be solved by the present invention is how to realize the setting of nailing force.

The present invention is realized by the following technical solutions: an nail gun, comprising: a control circuit unit, a motor electrically coupled and responsive to the control circuit unit, a first cylinder, a first piston moveably disposed in the first cylinder and defining a first working chamber with the first cylinder, a second cylinder, a second piston moveably disposed in the second cylinder and defining a second working chamber with the second cylinder, the second working chamber communicating with the first working chamber, the second piston capable of being driven by the motor to execute a compression stroke and a return stroke in an operation cycle, a driving ram fixedly connected with the first piston and the driving ram disposed with a recess, a pawl capable of engaging in the recess to retain the driving ram and disengaging out of the recess to release the driving ram, a linear motion actuator electrically coupled to the control circuit unit, the linear motion actuator capable of driving the pawl to retain or release the driving ram. During the compression stroke, the pawl retains the driving ram, and the control circuit unit is configured to calculate a predetermined distance value of the second piston and control the second piston to move and form a predetermined compressing pressure in the second working chamber. The control circuit unit is configured to control the linear motion actuator to release the driving ram when the second piston moves the predetermined distance.

One embodiment of the linear motion actuator is a solenoid valve, the second piston is capable of being driven by the motor to compress the air in the second cylinder to form high-pressure air. When the driving ram is locked, the high-pressure air is located in the first cylinder and the second cylinder. When the driving ram is unlocked, the first piston is pushed by the high-pressure air to cause the driving ram to move to strike a nail, and cause the nail gun to fire the nail. The control circuit unit of the nail gun can be quickly set with one predetermined distance or a plurality of predetermined distances by a technician, and a predetermined distance can be selected when the nail gun is ready for nailing work. When nailing is to be performed, the control circuit unit transmits a control signal to the motor driving circuit of the motor. The motor driving circuit controls the motor to start rotating, rotation of the motor drives the second piston to move and compress the air in the second cylinder to form a high pressure. When the second piston moves to the predetermined distance, the control circuit unit controls the solenoid valve to operate, the valve rod of the solenoid valve pushes the pawl to cause the pawl to unlock the driving ram, and the driving ram quickly strikes the nail under the action of high-pressure air to fire the nail.

When one embodiment of the second piston is at different positions in the second cylinder, pressures of the compressed air are different, and the driving ram is unlocked under different pressures. Movement speeds of the driving ram are different and impact energies to the nails are different, so nailing forces are different. When the nail gun is set with a predetermined distance, data of the predetermined distance can also be adjusted after the nail gun's production and design are finalized, so that the pressure of the compressed air can be changed when the driving ram is unlocked, and thus the nailing force can be changed. When the nail gun is preset with a plurality of predetermined distances, different nailing forces can be selected by selecting different predetermined distances, thereby realizing adjustability of the nailing force, increasing the applicable range of the nail gun, and improving the practicality of the nail gun. Therefore, the nail gun is capable of realizing rapid adjustment of the nailing force. Setting relevant data as a trigger point for the control circuit unit to trigger and output the control signal is prior art. The predetermined distance is selected through the adjustment button, the adjustment button has a plurality of pressure ratings to be selected, so that the control circuit unit is set with a plurality of predetermined distances, the number of which corresponds to the number of the pressure ratings, and therefore the nailing force can be selected voluntarily during the use of the nail gun.

In one embodiment of the above-mentioned nail gun, the control circuit unit comprises a motor driving circuit capable of driving the motor to rotate, a counter capable of counting a rotation number of the motor, the control circuit unit is configured to calculate the predetermined distance value of the second piston through a predetermined rotation number of the motor and output a stop signal to the motor driving circuit based on a predetermined value of the counter.

In one embodiment of the above-mentioned nail gun, the nail gun further comprises a pressure ratings option mechanism electrically coupled to the control circuit unit, the pressure ratings option mechanism comprising an adjustment button having at least two pressure ratings. The adjustment button is configured to select a selected pressure rating of the pressure ratings, the control circuit unit comprises a processing unit capable of receiving a selected signal of the pressure ratings, the control circuit unit is configured to calculate the selected signal into the predetermined rotation number of the motor.

In one embodiment of the above-mentioned nail gun, the nail gun further comprises a power supply, the control circuit unit and the motor are electrically connected to the power source respectively, and the linear motion actuator is a solenoid valve which comprises a coil electrically connected to the control circuit unit.

In one embodiment of the above-mentioned nail gun, the motor is a DC motor, a speed reducer is connected to an output shaft of the motor, a crank is connected to an output shaft of the speed reducer, a connecting rod is connected between the second piston and the crank to form a crank linkage mechanism.

One embodiment of the speed reducer transmits power from the motor at reduced speed, the output shaft of the speed reducer drives the crank to rotate one turn so that the second piston completes a reciprocating motion, that is, the second piston completes a reciprocating cycle. The processing unit controls the motor to start, so that rotation of the motor causes the second piston to start to reciprocate. At this time, the counter starts counting, and a rotation speed of the motor is constant, thus the rotation number of motor required to move the second piston to each position is also constant. Therefore, when the second piston reaches each predetermined position, the motor has a fixed and corresponding rotation number, and setting the rotation number of motor required to unlock the driving ram is also presetting the predetermined distances. The control circuit unit examines the signal transmitted by the counter to obtain the current rotation number of the motor, and when the current rotation number of the motor is the same as the rotation number of the motor corresponding to the selected predetermined distance, the control circuit unit controls the solenoid valve to operate.

In one embodiment of the above-mentioned nail gun, the nail gun further comprises a housing, the housing is provided with an inner shell therein, and the pawl is rotatably connected to the inner shell, the pawl comprises an engaging portion and a connection portion integrally connected with the engaging portion, the engaging portion and the connection portion are connected to form an L shape, the engaging portion is provided with a cusp capable of engaging into the recess of the driving ram, the connection portion is provided with an elongated through hole, the solenoid valve further comprises an iron core valve rod inserted inside the coil, and the valve rod is connected inside the through hole of the connection portion. Through the above disposition, when the valve rod of the solenoid valve pushes the connection portion, the pawl rotates as a whole, and the cusp on the engaging portion leaves the recess of the driving ram to unlock the driving ram.

In one embodiment of the above-mentioned nail gun, the engaging portion is fixedly connected with a synchronous shaft capable of rotating circumferentially, the engaging portion is located at a first end of the synchronous shaft, a second end of the synchronous shaft is connected with a block, the synchronous shaft is further sleeved with a torsion spring, a first end of the torsion spring acts on the block and a second end of the torsion spring acts on the inner shell. Through the above disposition, when the torsion spring is deformed by the movement of the block, a reacting force of the torsion spring causes the engaging portion to have a tendency to move toward the driving ram. When the driving ram is reset to its position, the cusp of the engaging portion is engaged into the recess of the driving ram under the action of the torsion spring to lock the driving ram.

In one embodiment of the above-mentioned nail gun, the synchronous shaft is sleeved with a bushing, the bushing is fixed inside the inner shell, and the torsion spring is sleeved on the bushing. By disposing the bushing between the torsion spring and the synchronous shaft, rotational friction of the synchronous shaft is reduced, so that the synchronous shaft rotates more smoothly.

In one embodiment of the above-mentioned nail gun, the coil is electrically connected to an output end of the control circuit unit, one end of the valve rod extends outside of the coil and is bent and protruded into the through hole, when the coil is energized, the valve rod is capable of moving to drive the cusp of the engaging portion away from the recess of the driving ram. The control circuit unit controls power-on and power-off of the coil, the valve rod is actuated after the coil is energized, and after the valve rod is actuated, the pawl is pushed to unlock the driving ram.

In one embodiment of the above-mentioned nail gun, the driving ram is provided with two recesses, the engaging portion is provided with two cusps, and the two cusps are capable of engaging into a corresponding recess of the driving ram. Through the above disposition, the driving ram is more securely locked by the pawl, so that the pawl can be prevented from disengaging from the driving ram under high pressure gas.

An nail gun, comprising: a control circuit unit, a motor electrically coupled and responsive to the control circuit unit, a first cylinder, a first piston moveably disposed in the first cylinder and defining a first working chamber with the first cylinder, a second cylinder, a second piston moveably disposed in the second cylinder and defining a second working chamber with the second cylinder, the second working chamber communicating with the first working chamber, the second piston capable of being driven by the motor to execute a compression stroke and a return stroke in an operation cycle, a driving ram fixedly connected with the first piston and the driving ram disposed with a recess, a pawl capable of engaging in the recess to retain the driving ram and disengaging out of the recess to release the driving ram, a linear motion actuator electrically coupled to the control circuit unit, the linear motion actuator capable of driving the pawl to retain or release the driving ram, and a delayer electrically coupled to the control circuit unit. During the compression stroke, the pawl retains the driving ram, and the control circuit unit is configured to calculate a predetermined distance value of the second piston based on a time value of the delayer and control the second piston to move and form a predetermined compressing pressure in the second working chamber. The control circuit unit is configured to control the linear motion actuator to release the driving ram when the second piston moves the predetermined distance. The sensor detects a position of the second piston and sends a signal to the control circuit unit, and then the control circuit unit controls the delayer start to timing, when the second piston moves a predetermined distance based on the setting time of the delayer, a predetermined compressing pressure are formed in the second working chamber, and then the control circuit unit controls the solenoid valve to actuate and to unlock the driving ram.

In one embodiment of the above-mentioned nail gun, the nail gun further comprises a pressure ratings option mechanism electrically coupled to the control circuit unit, the pressure ratings option mechanism comprising a sensor capable of detecting a predetermined point and the delayer capable of set different time values to form at least two pressure ratings in the second working chamber, and the delayer starts timing when the control circuit unit receives a detecting signal from the sensor.

In one embodiment of the above-mentioned nail gun, the nail gun further comprises a power supply, the control circuit unit and the motor are electrically connected to the power source respectively, and the linear motion actuator is a solenoid valve which comprises a coil electrically connected to the control circuit unit.

In one embodiment of the above-mentioned nail gun, the control circuit unit comprises a motor driving circuit capable of driving the motor to rotate, and a processing unit capable of receiving a signal of the sensor, the delayer is integrated in the control circuit unit, the control circuit unit is configured to control the delayer for timing and outputting a stop signal to the motor driving circuit based on a predetermined time value of the delayer.

In one embodiment of the above-mentioned nail gun, the motor is a DC motor, a speed reducer is connected to an output shaft of the motor, a crank is connected to an output shaft of the speed reducer, a connecting rod is connected between the second piston and the crank to form a crank linkage mechanism.

In one embodiment of the above-mentioned nail gun, the nail gun further comprises a housing, the housing is provided with an inner shell therein, and the pawl is rotatably connected to the inner shell, the pawl comprises an engaging portion and a connection portion integrally connected with the engaging portion, the engaging portion and the connection portion are connected to form an L shape, the engaging portion is provided with a cusp capable of engaging into the recess of the driving ram, the connection portion is provided with an elongated through hole, the solenoid valve further comprises an iron core valve rod inserted inside the coil, and the valve rod is connected inside the through hole of the connection portion. Through the above disposition, when the valve rod of the solenoid valve pushes the connection portion, the pawl rotates as a whole, and the cusp on the engaging portion leaves the recess of the driving ram to unlock the driving ram.

In one embodiment of the above-mentioned nail gun, the engaging portion is fixedly connected with a synchronous shaft capable of rotating circumferentially, the engaging portion is located at a first end of the synchronous shaft, a second end of the synchronous shaft is connected with a block, the synchronous shaft is further sleeved with a torsion spring, a first end of the torsion spring acts on the block and a second end of the torsion spring acts on the inner shell. Through the above disposition, when the torsion spring is deformed by the movement of the block, a reacting force of the torsion spring causes the engaging portion to have a tendency to move toward the driving ram. When the driving ram is reset to its position, the cusp of the engaging portion is engaged into the recess of the driving ram under the action of the torsion spring to lock the driving ram.

In one embodiment of the above-mentioned nail gun, the synchronous shaft is sleeved with a bushing, the bushing is fixed inside the inner shell, and the torsion spring is sleeved on the bushing. By disposing the bushing between the torsion spring and the synchronous shaft, rotational friction of the synchronous shaft is reduced, so that the synchronous shaft rotates more smoothly.

In one embodiment of the above-mentioned nail gun, the coil is electrically connected to an output end of the control circuit unit, one end of the valve rod extends outside of the coil and is bent and protruded into the through hole, when the coil is energized, the valve rod is capable of moving to drive the cusp of the engaging portion away from the recess of the driving ram. The control circuit unit controls power-on and power-off of the coil, the valve rod is actuated after the coil is energized, and after the valve rod is actuated, the pawl is pushed to unlock the driving ram.

In one embodiment of the above-mentioned nail gun, the driving ram is provided with two recesses, the engaging portion is provided with two cusps, and the two cusps are capable of engaging into a corresponding recess of the driving ram. Through the above disposition, the driving ram is more securely locked by the pawl, so that the pawl can be prevented from disengaging from the driving ram under high pressure gas.

Compared with the prior art, the present invention has the following advantages:

The present invention controls and unlocks the driving ram by setting the control circuit unit, so that unlocking and controlling can be performed based on where the second piston is in the second cylinder. Therefore different nailing forces can be selected by selecting different set unlock distances, thereby realizing adjustability of the nailing force, increasing the applicable range of the nail gun, and improving the practicality of the nail gun.

DETAILED DESCRIPTION OF THE INVENTION

The technical solutions of the present invention are further described below with reference to the specific embodiments of the present invention in conjunction with the accompanied drawings, but the present invention is not limited to the embodiments.

Embodiment 1

Figure 1:
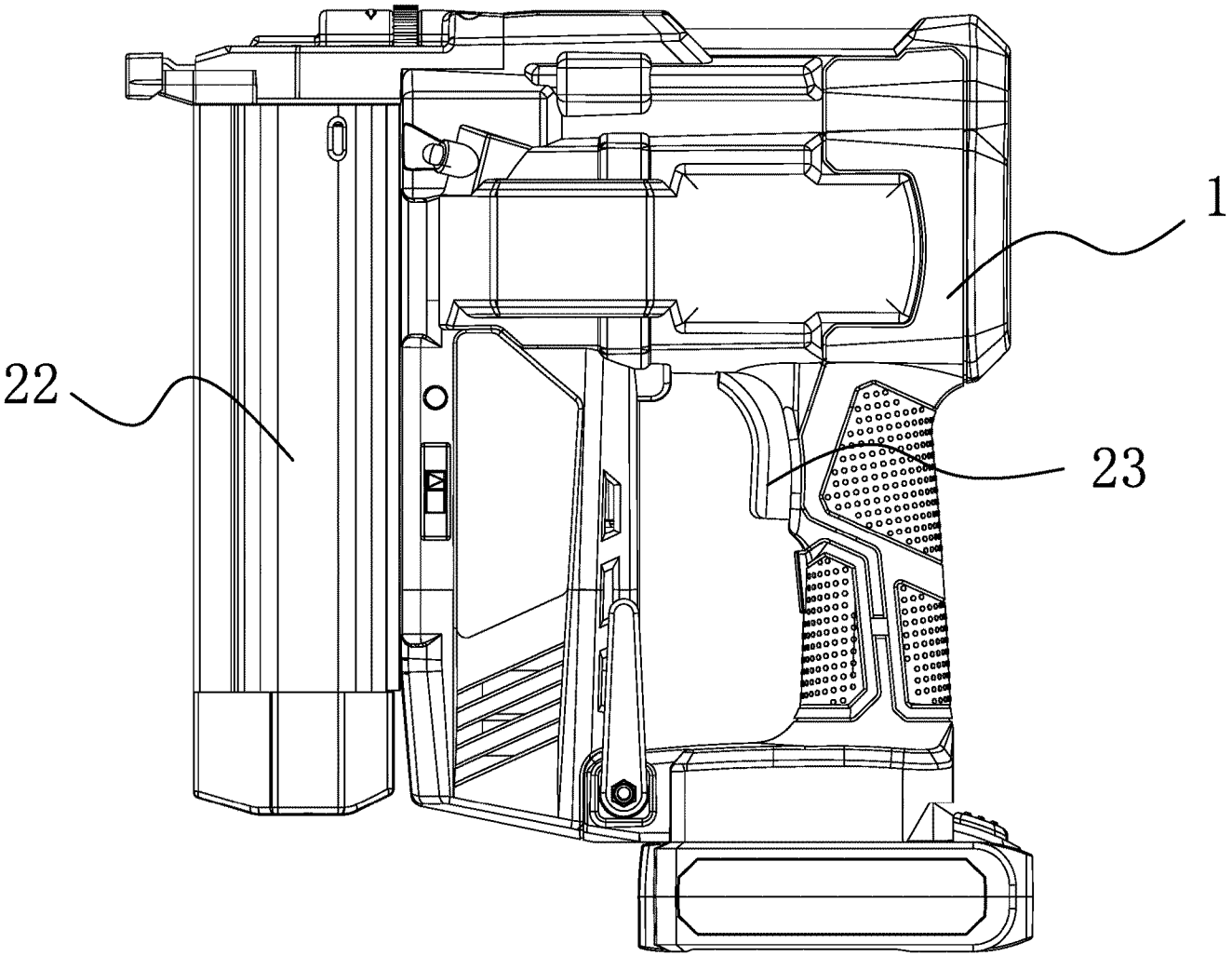
FIG. 1 is a schematic structural view of one embodiment of a housing according to a first embodiment of the present invention.
Figure 2:
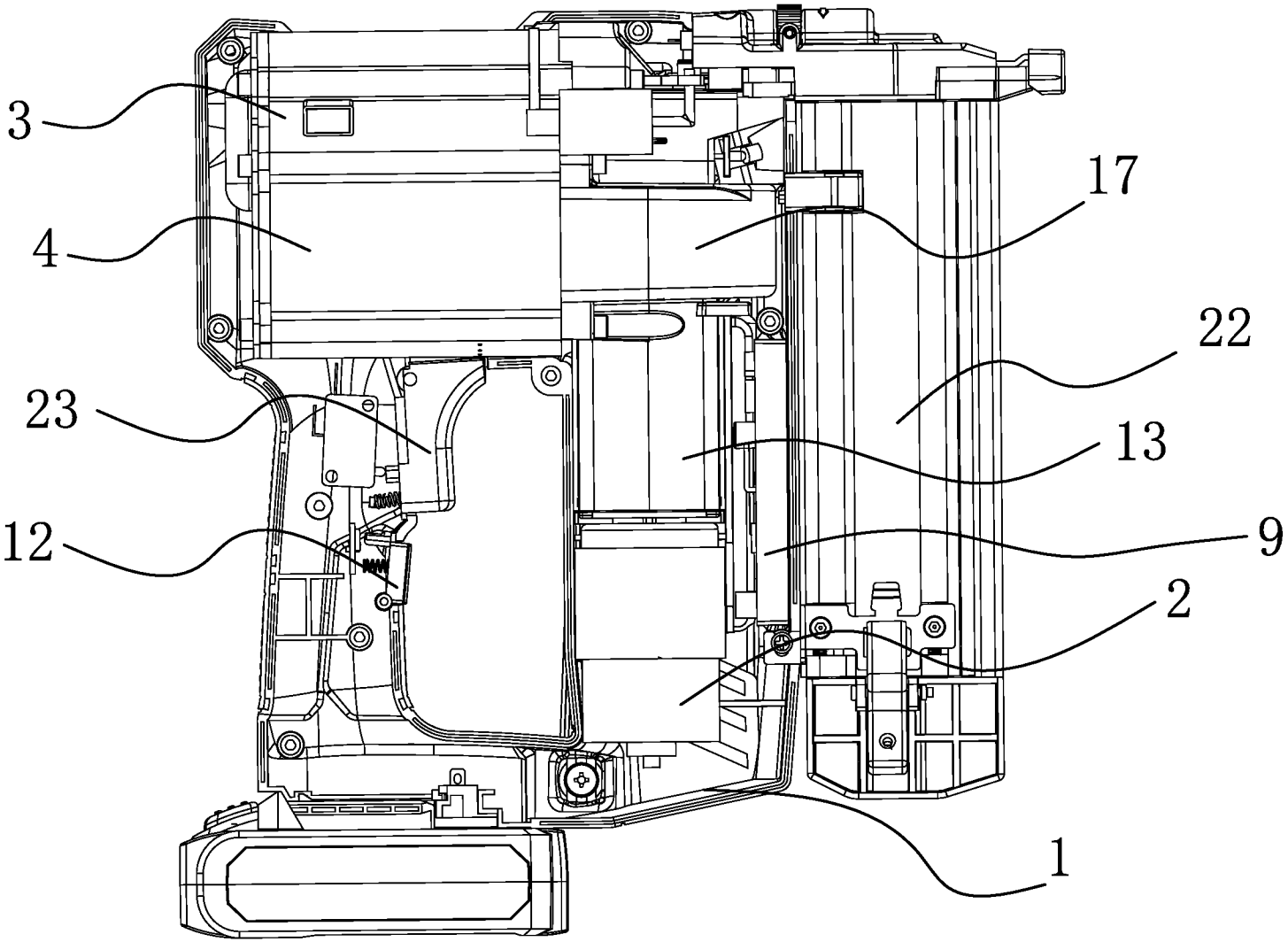
FIG. 2 is a schematic structural view inside one embodiment of the housing according to a first embodiment of the present invention.
Figure 3:
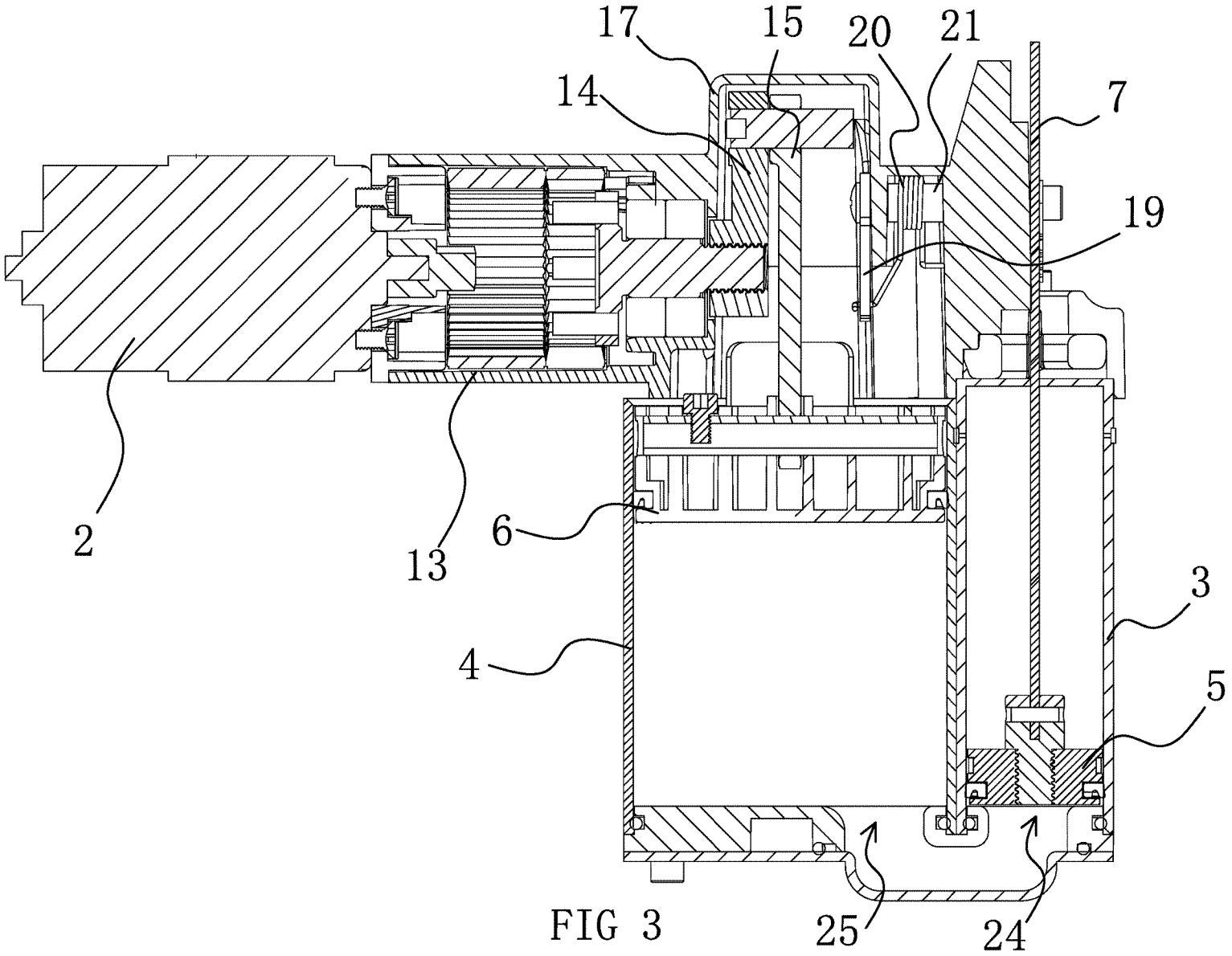
FIG. 3 is a cross-sectional view of one embodiment of the driving ram being retained by a linear motion actuator according to a first embodiment of the present invention.

As shown in FIG. 1, one embodiment of a nail gun comprises a housing 1, the housing 1 is provided with a trigger 23 and a cartridge clip 22 capable of accommodating a row of nails.

As shown in FIG. 2 to FIG. 9, one embodiment of the housing 1 is provided with a motor 2, a closed first cylinder 3 and a closed second cylinder 4 within the housing 1, a bottom of a working chamber of the first cylinder 3 has a first connect hole 24, a bottom of the second cylinder 4 has a second connect hole 25, and the first connect hole 24 and the second connect hole 25 communicate with each other. A first piston 5 is disposed in the working chamber of the first cylinder 3 and the first piston 5 is fixedly connected with a driving ram 7, the driving ram 7 is disposed with a recess 7*a*, the housing 1 is further provided with a pawl 8 therein, the pawl 8 is capable of engaging in the recess 7*a* to lock the driving ram 7, a second piston 6 is disposed in a working chamber of the second cylinder 4 and the second piston 6 is capable of being driven by the motor 2 to move in the working chamber of the second cylinder 4.

Figure 5:
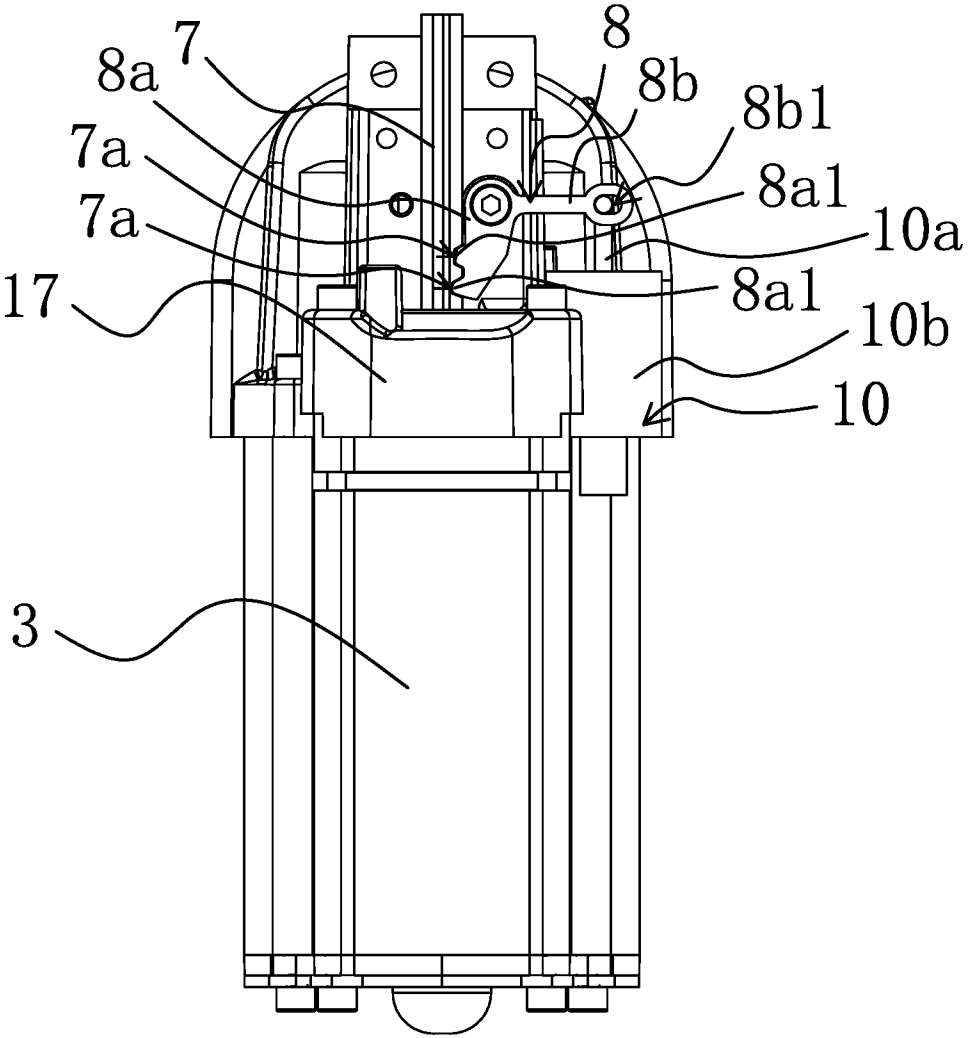
FIG. 5 is a schematic structural view of one embodiment of a driving ram being locked by a pawl according to a first embodiment of the present invention.
Figure 6:
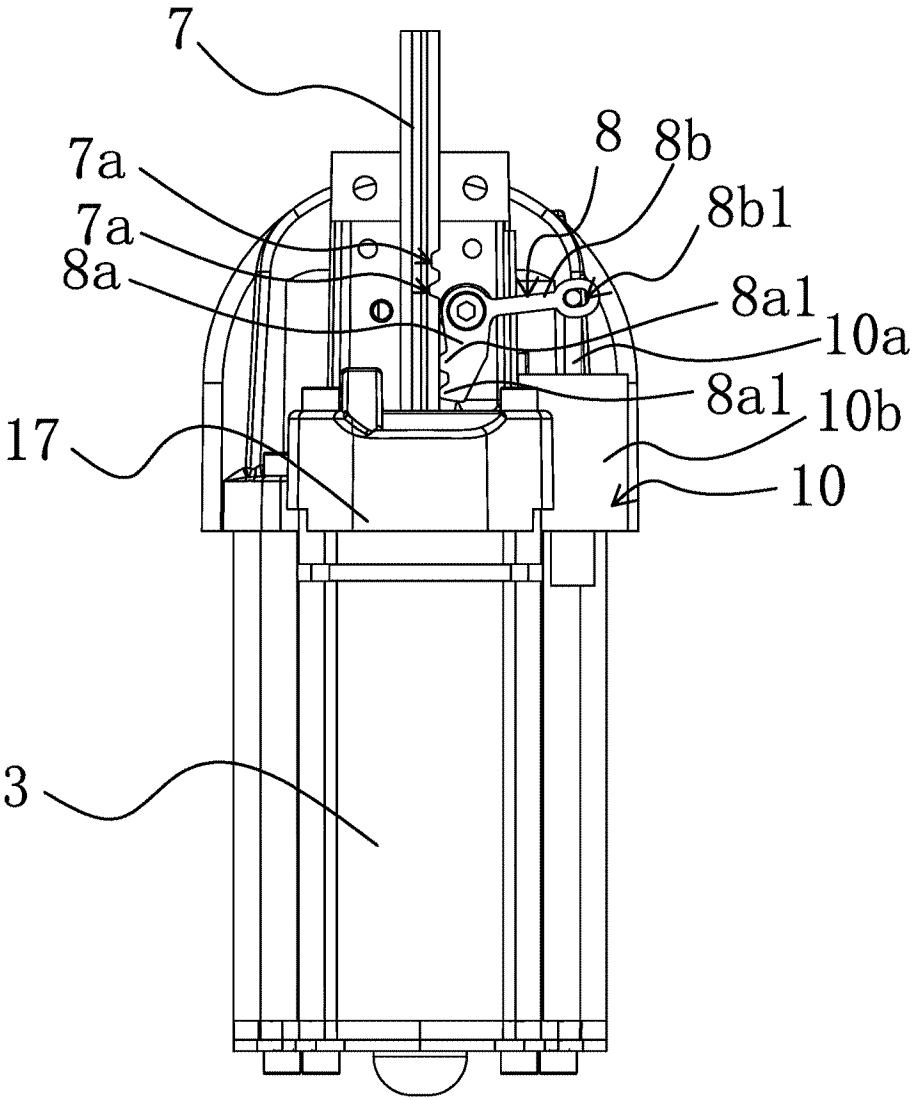
FIG. 6 is a schematic structural view of one embodiment of the driving ram being released by the pawl according to a first embodiment of the present invention.
Figure 7:
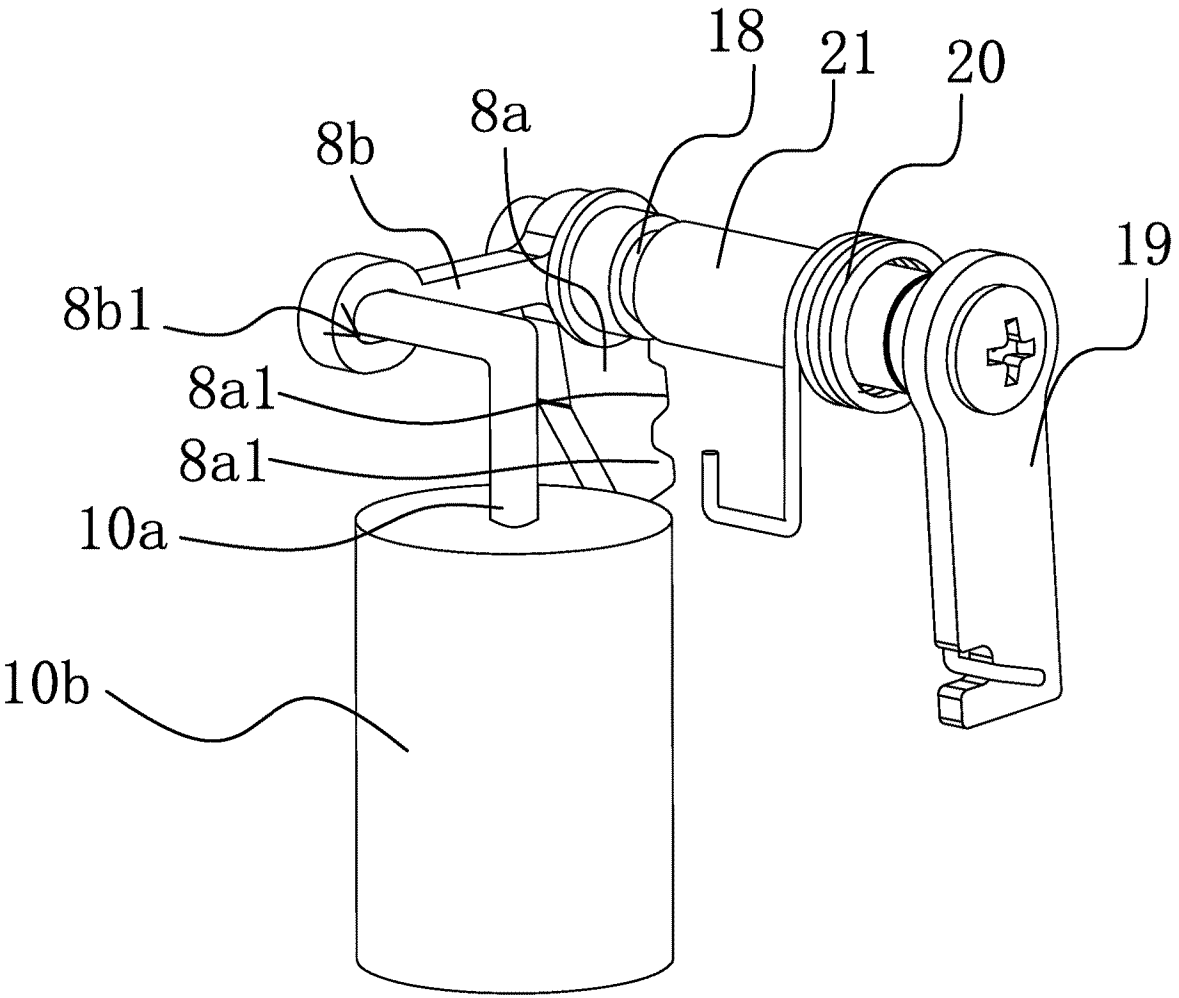
FIG. 7 is a first schematic structural view of the connection of one embodiment of the pawl with a synchronous shaft and a solenoid valve according to a first embodiment of the present invention.
Figure 9:
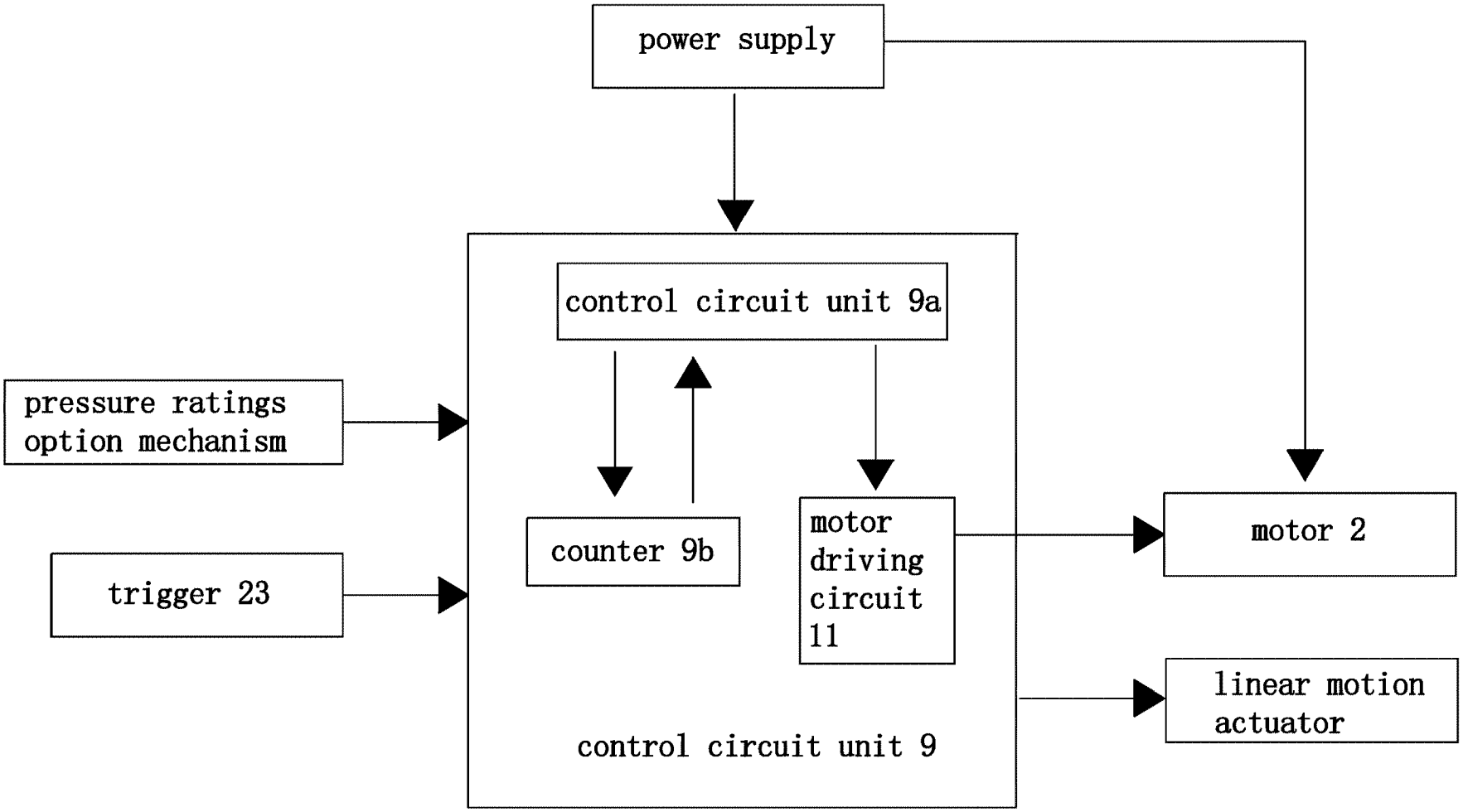
FIG. 9 is a block diagram of a circuit connection structure according to a first embodiment of the present invention.

As shown in FIG. 5, FIG. 6 and FIG. 9, one embodiment of the nail gun further comprises a control circuit unit 9, a pressure ratings option mechanism electrically coupled to the control circuit unit 9, and a linear motion actuator. The linear motion actuator may be a solenoid valve 10, or a rack and pinion driven by a servo motor, or a piston rod driven by a cylinder. The solenoid valve 10 controlled by the control circuit unit 9, a valve rod 10*a* of the solenoid valve 10 is connected with the pawl 8 and capable of pushing the pawl 8 to unlock the driving ram 7, the control circuit unit 9 is respectively connected to a motor driving circuit 11 of the solenoid valve 10 and a motor driving circuit 11 of the motor 2, and the control circuit unit 9 is capable of controlling rotation of the motor 2 to push the second piston 6 to move and capable of controlling actuation of the solenoid valve 10 when the second piston 6 moves a predetermined distance.

Figure 4:
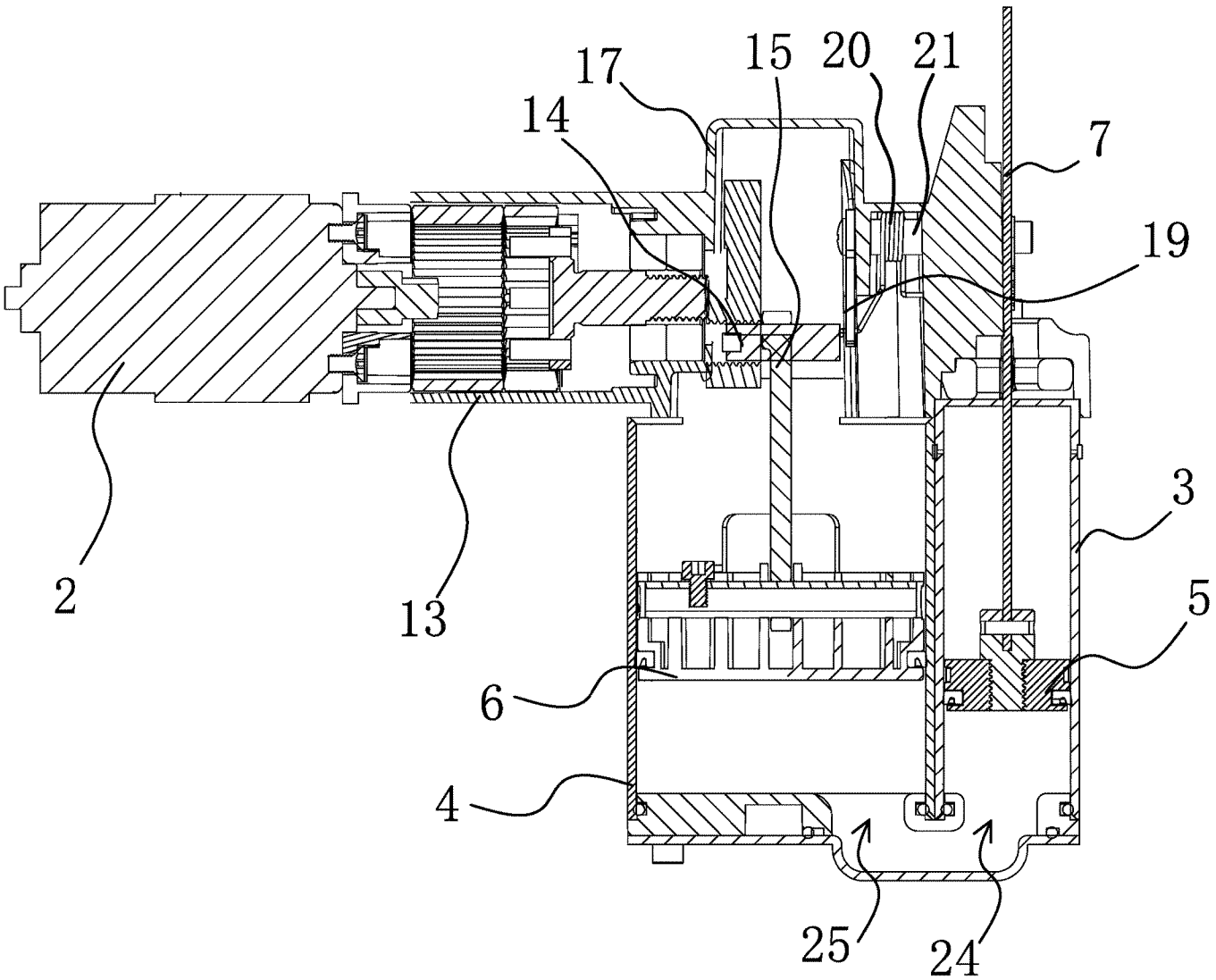
FIG. 4 is a cross-sectional view of one embodiment of the driving ram being released by a linear motion actuator according to a first embodiment of the present invention.
Figure 8:
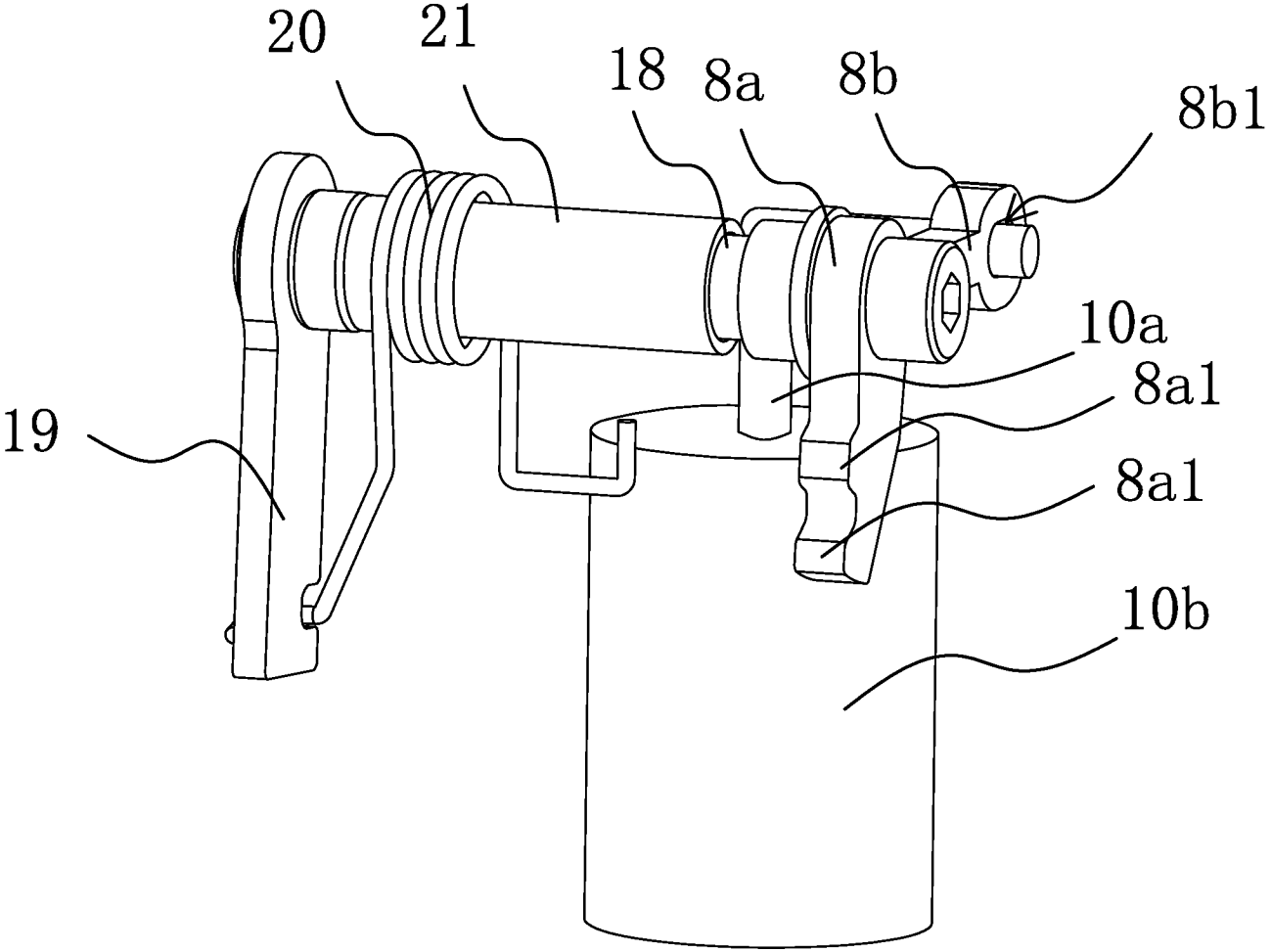
FIG. 8 is a second schematic structural view of the connection of one embodiment of the pawl with the synchronous shaft and the solenoid valve according to a first embodiment of the present invention.

As shown in FIG. 4 and FIG. 8, one embodiment of the pressure ratings option mechanism comprising an adjustment button 9 having at least two pressure ratings, the adjustment button 12 is capable of selecting a predetermined distance to cause the control circuit unit 9 to control the actuation of the solenoid valve 10, and the adjustment button 12 is a pressure rating adjustment button and is capable of adjusting to at least two pressure ratings, with each rating corresponding to a predetermined distance. The trigger 23 is connected to an input end of the control circuit unit 9. The motor 2 is a DC motor, a speed reducer 13 is connected to an output shaft of the motor 2, a crank 14 is connected to an output shaft of the speed reducer 13, and a connecting rod 15 is connected between the second piston 6 and the crank 14 to form a crank linkage mechanism. Inside the control circuit unit 9 is integrated with a processing unit 9*a* capable of outputting a control signal to control the rotation of the motor 2, and a counter module 9*b* capable of counting a number of revolutions of the motor 2, and the processing unit 9*a* is connected to the motor driving circuit 11 of the motor 2.

As shown in FIG. 2 to FIG. 8, one embodiment of the housing 1 is provided with an inner shell 17 therein, and the pawl 8 is rotatably connected to the inner shell 17. The pawl 8 comprises a engaging portion 8*a* and a connection portion 8*b* integrally connected with the engaging portion 8*a*, the engaging portion 8*a* and the connection portion 8*b* are connected to form an L shape. The engaging portion 8*a* is provided with a cusp 8*a*1 capable of engaging into the recess 7*a* of the driving ram 7, the connection portion 8*b* is provided with an elongated through hole 8*b*1, and the valve rod 10*a* of the solenoid valve 10 is connected inside the through hole 8*b*1 of the connection portion 8*b*. The engaging portion 8*a* is fixedly connected with a synchronous shaft 18 capable of rotating circumferentially, the engaging portion 8*a* is located at one end of the synchronous shaft 18, and another end of the synchronous shaft 18 is connected with a block 19. The synchronous shaft 18 is further sleeved with a torsion spring 20, one end of the torsion spring 20 acts on the block 19 and another end of the torsion spring 20 acts on the inner shell 17. The synchronous shaft 18 is sleeved with a bushing 21, the bushing 21 is fixed inside the inner shell 17, and the torsion spring 20 is sleeved on the bushing 21. The motor 2, the speed reducer 13, the first cylinder 3 and the second cylinder 4 are fixed on the inner shell 17.

As shown in FIG. 3 to FIG. 9, one embodiment of the solenoid valve 10 comprises a coil 10*b* and the iron core valve rod 10*a*, the iron core valve rod 10*a* is inserted inside the coil 10*b*, the coil 10*b* is connected to an output end of the control circuit unit 9, one end of the valve rod 10*a* extends outside of the coil 10*b* and is bent and protruded into the through hole 8*b*1. When the coil 10*b* is energized, the valve rod 10*a* is capable of moving to drive the cusp 8*a*1 of the engaging portion 8*a* away from the recess 7*a* of the driving ram 7.

As shown in FIG. 5 and FIG. 6, one embodiment of the driving ram 7 is provided with two recesses 7*a*, there are two cusps 8*a*1 on the engaging portion 8*a* and the two cusps 8*a*1 are capable of engaging into the recess 7*a* of the driving ram 7, with one cusp 8*a*1 engaging into a corresponding recess 7*a*.

One embodiment of the second piston 6 is capable of being driven by the motor 2 to compress air in the second cylinder 4 to form high-pressure air. When the driving ram 7 is locked, the high-pressure air is located in the first cylinder 3 and the second cylinder 4. When the driving ram 7 is unlocked, the first piston 5 is pushed by the high-pressure air to cause the driving ram 7 to move to strike a nail, and cause the nail gun to fire the nail.

One embodiment of the control circuit unit 9 of the nail gun can be quickly set with one predetermined distance or a plurality of predetermined distances by a technician. When the nail gun is set with only one predetermined distance, data of the predetermined distance can also be adjusted after the nail gun's production and design are finalized, so that the pressure of the compressed air can be changed when the driving ram 7 is unlocked, and thus the nailing force can be changed, thereby achieving an object of adjustability of the nailing force.

Preferably, in this embodiment, there are two pressure ratings for selecting, that is, two different predetermined distances are preset. Before nailing, one of the pressure ratings is selected by the adjustment button 12, that is, one of the predetermined distances is selected as the current nailing condition, so that an operator can select the nailing force voluntarily when the nail gun is used.

When a predetermined distance is selected and one embodiment of the trigger 23 is pressed to output a signal to the control circuit unit 9, the processing unit 9*a* of the control circuit unit 9 transmits a control signal to the motor driving circuit 11 of the motor 2 to start the rotation of the motor 2. The speed reducer 13 transmits power from the motor 2 at reduced speed, the output shaft of the speed reducer 13 drives the crank 14 to rotate one turn so that the second piston 6 completes a reciprocating motion, that is, the second piston 6 completes a nailing cycle.

After one embodiment of the motor 2 is controlled to operate, the counter 9*b* starts counting a rotation number of the motor 2, a rotation speed of the motor 2 is constant, thus the rotation number of motor required to move the second piston to each position is also constant. Therefore, when the second piston 6 moves each predetermined distance, the motor 2 has a fixed and corresponding rotation number, and setting the rotation number of motor required to unlock the driving ram 7 is also presetting the predetermined distance. The control circuit unit 9 examines the signal transmitted by the counter 9*b* to obtain the current number of revolutions of the motor 2, and when the current rotation number of the motor 2 is the same as the rotation number of the motor 2 corresponding to the selected predetermined distance, the control circuit unit 9 controls the coil 10*b* of the solenoid valve 10 to be energized. Thereby the valve rod 10*a* moves and pushes the connection portion 8*b* of the pawl 8, the pawl 8 rotates as a whole, and the cusp 8*a*1 on the engaging portion 8*a* leaves the recess 7*a* of the driving ram 7 to unlock the driving ram 7. At this time, because of the high-pressure air, the driving ram 7 is driven by the first piston 5 to strike the nail, and nailing is performed.

After one embodiment of the driving ram 7 performs a nail firing, the motor 2 continues to work until the second piston 6 is reset to its position, completing a nailing cycle. When the motor 2 starts to rotate, the second piston 6 moves toward the second connect hole 25 to compress air toward the first piston 5. When nail firing by the driving ram 7 is completed, during the reset process of the second piston 6, the working chamber of the second cylinder 4 generates a negative pressure, so that the first piston 5 in the first cylinder 3 also begins reset movement to cause the driving ram 7 to be reset. Since the pawl 8 is driven by the valve rod 10*a* when the driving ram 7 is unlocked, the synchronous shaft 18 also rotates, and the synchronous shaft 18 is rotated to cause the block 19 to apply a force to the torsion spring 20 to deform the torsion spring 20. Thus a rebound force generated by deformation of the torsion spring 20 is acted on the block 19, that is, the engaging portion 8*a* of the pawl 8 is caused to have a tendency to move toward the driving ram 7. After the pawl 8 unlocks the driving ram 7, the control circuit unit 9 controls the coil 10*b* to be de-energized, so that the valve rod 10*a* does not apply a force to the pawl 8. Therefore, when the driving ram 7 is reset to its position, the cusp 8*a*1 is driven by the torsion spring 20 to re-engage into the recess 7*a* of the driving ram 7.

One embodiment of the nail gun is capable of realizing adjustability of the nailing force whether one predetermined distance is preset or a plurality of predetermined distances is preset. Moreover, when the nail gun is preset with a plurality of predetermined distances, different nailing forces can be selected by selecting different predetermined distances by the operator freely, thereby realizing adjustability of the nailing force, increasing the applicable range of the nail gun, and improving the practicality of the nail gun.

Embodiment 2

Figure 10:
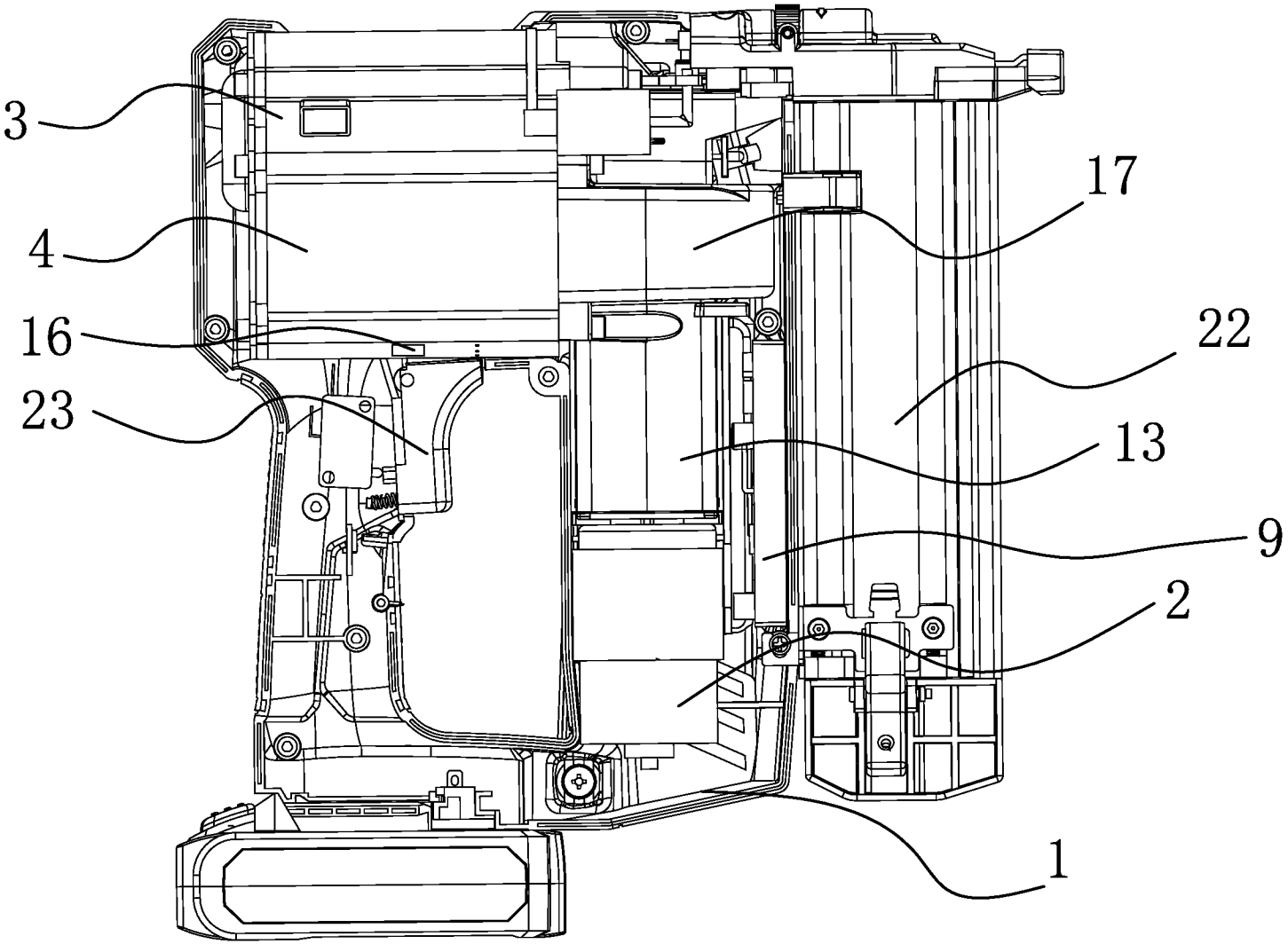
FIG. 10 is a schematic structural view inside one embodiment of the housing according to a second embodiment of the present invention.
Figure 11:
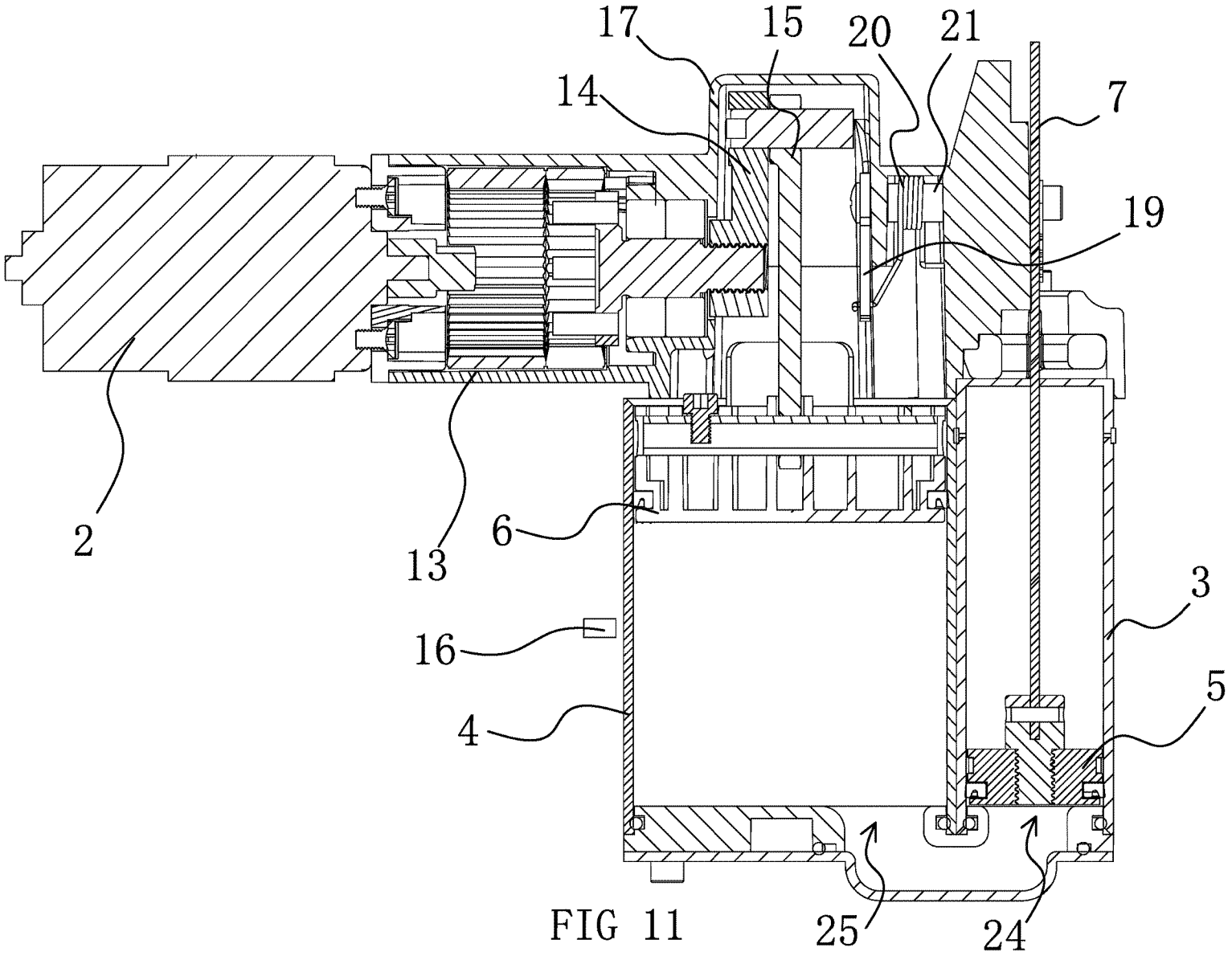
FIG. 11 is a cross-sectional view of one embodiment of the driving ram being retained by a linear motion actuator according to a second embodiment of the present invention.
Figure 12:
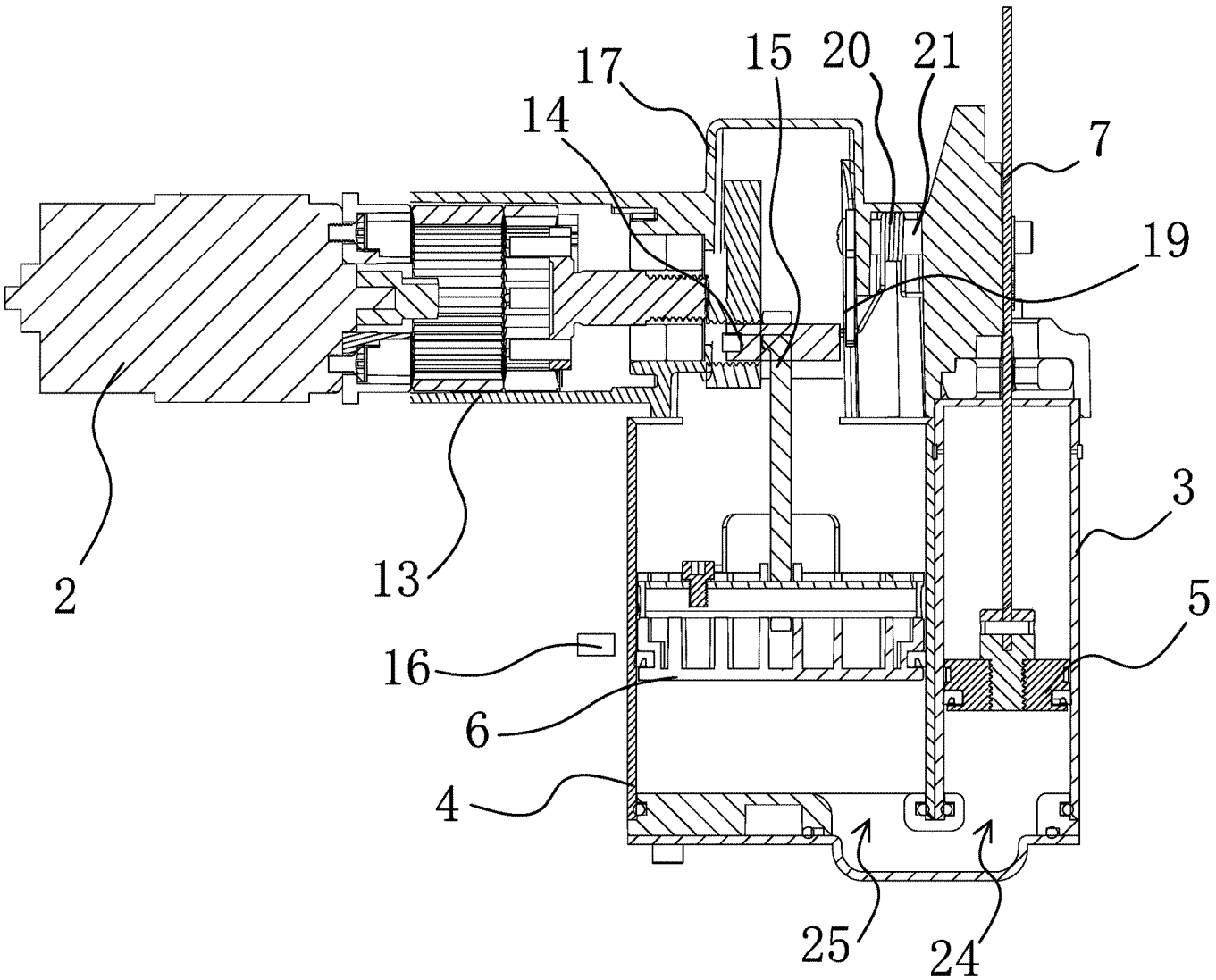
FIG. 12 is a cross-sectional view of one embodiment of the driving ram being released by a linear motion actuator according to a second embodiment of the present invention.
Figure 13:
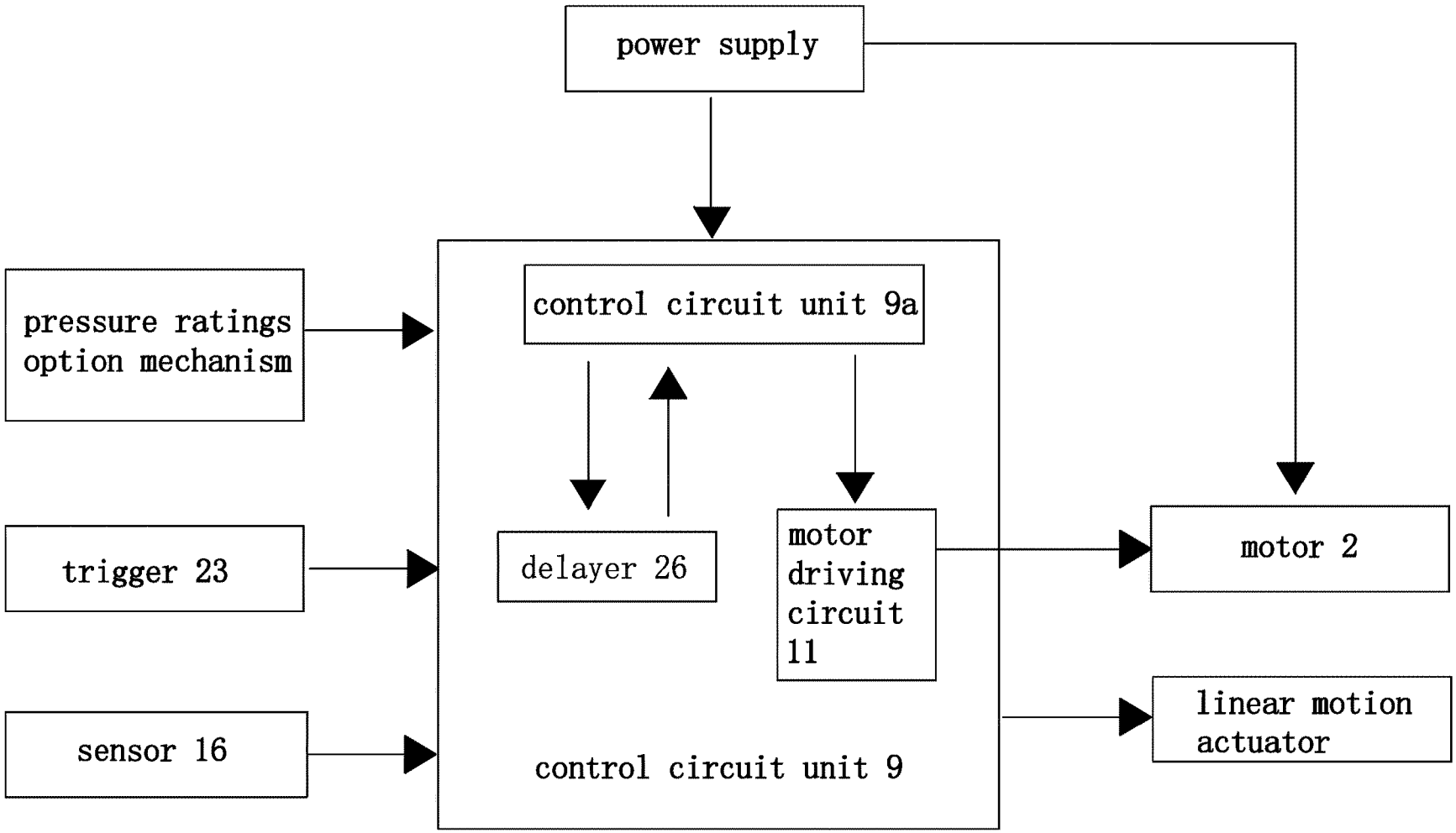
FIG. 13 is a block diagram of a circuit connection structure according to a second embodiment of the present invention.

The second embodiment has basically the same structure and principle as the first embodiment, and the differences are shown in FIG. 10-to FIG. 13, the pressure ratings option mechanism comprises a sensor 16 for detecting a predetermined point, and a delayer 26 for delaying different time values to form at least two pressure ratings in the second working chamber, the delayer 26 start timing when the control circuit unit 9 receives a detecting signal from the sensor 16. The delayer 26 is configured to set a time value of the different time values, during the compression stroke, the pawl 8 retains the driving ram 7, the control circuit unit 9 is configured to control the motor 2 rotating and the motor 2 drives the second piston 6 to a predetermined distance based on the setting time of the delayer 26 to form a predetermined compressing pressure in the second working chamber; the control circuit unit 9 is configured to control the linear motion actuator to release the driving ram 7 when the second piston 6 moves the predetermined distance. The position of the sensor 16 corresponds to the middle of the second cylinder 4. And the control circuit unit 9 comprises a motor driving circuit 11 capable of driving the motor 2 to rotate, and a processing unit 9*a* capable of receiving a signal of the sensor 16, the delayer 26 is integrated in the control circuit unit 9, the control circuit unit 9 is configured to control the delayer 26 for timing and outputting a stop signal to the motor driving circuit 11 based on a predetermined time value of the delayer 26.

The sensor 16 detects a position of the second piston 6 and sends a signal to the control circuit unit 9, and then the control circuit unit 9 controls the delayer 26 start to timing, when the second piston 6 moves a predetermined distance based on the setting time of the delayer 26, the motor driving circuit 11 receives a stop signal from the control circuit unit 9 and controls the motor 11 to stop rotating, and a predetermined compressing pressure are formed in the second working chamber. And then the control circuit unit 9 controls the solenoid valve to actuate and to release the driving ram 7.

The delayer 26 may be a decaying delayer 26. If the time value of the delayer is set for 1 s, a stop signal will be sent from the delayer 26 when the time value of the delayer decays to 0.

The delayer 26 may be an increasing delayer 26. If the time value of the delayer is set for 1 s, a stop signal will be sent from the delayer 26 when the time value of the delayer increases to 1.

The specific embodiments described herein are merely illustrative of the spirit of the present invention. Technical personnel skilled in the art to which the present invention pertains can make various modifications or additions to the specific embodiments described or replace them in a similar manner, without departing from the spirit of the present invention or beyond the scope defined by the appended claims.

Although the technical terms housing 1, motor 2, first cylinder 3, second cylinder 4, first piston 5, second piston 6, driving ram 7, recess 7*a*, pawl 8, engaging portion 8*a*, cusp 8*a*1, connection portion 8*b*, through hole 8*b*1, control circuit unit 9, processing unit 9*a*, counter 9*b*, solenoid valve 10, valve rod 10*a*, coil 10*b*, motor driving circuit 11, adjustment button 12, speed reducer 13, crank 14, connecting rod 15, sensor 16, inner shell 17, synchronous shaft 18, block 19, torsion spring 20, bushing 21, cartridge clip 22, trigger 23, first connect hole 24, second connect hole 25 and delayer 26 are used more frequently herein, the possibility of using other technical terms is not excluded. These technical terms are merely used to describe and explain the nature of the present invention more conveniently; construing them as any additional limitation is contrary to the spirit of the present invention.

LIST OF REFERENCED PARTS

1 housing
2 motor
3 first cylinder
4 second cylinder
5 first piston
6 second piston
7 driving ram
7*a* recess
8 pawl
8*a* engaging portion
8*a*1 cusp
8*b* connection portion
8*b*1 through hole
9 control circuit unit
9*a* processing unit
9*b* counter
10 solenoid valve
10*a* valve rod
10*b* coil
11 motor driving circuit
12 adjustment button
13 speed reducer
14 crank
15 connecting rod
16 sensor
17 inner shell
18 synchronous shaft
19 block
20 torsion spring
21 bushing
22 cartridge clip
23 trigger
24 first connect hole
25 second connect hole
26 delayer

What is claimed is:

1. An nail gun, comprising:

a control circuit unit;

a motor electrically coupled and responsive to the control circuit unit;

a first cylinder;

a first piston moveably disposed in the first cylinder and defining a first working chamber with the first cylinder;

a second cylinder;

a second piston moveably disposed in the second cylinder and defining a second working chamber with the second cylinder, the second working chamber communicating with the first working chamber, the second piston capable of being driven by the motor to execute a compression stroke and a return stroke in an operation cycle;

a driving ram fixedly connected with the first piston and the driving ram disposed with a recess;

a pawl capable of engaging in the recess to retain the driving ram and disengaging out of the recess to release the driving ram;

a linear motion actuator electrically coupled to the control circuit unit, the linear motion actuator capable of driving the pawl to retain or release the driving ram; and wherein during the compression stroke, the pawl retains the driving ram, and the control circuit unit is configured to calculate a predetermined distance value of the second piston and control the second piston to move and form a predetermined compressing pressure in the second working chamber;

wherein the control circuit unit is configured to control the linear motion actuator to release the driving ram when the second piston moves the predetermined distance.

2. The nail gun as claimed in claim 1, wherein the control circuit unit comprises a motor driving circuit capable of driving the motor to rotate, a counter capable of counting a rotation number of the motor, the control circuit unit is configured to calculate the predetermined distance value of the second piston through a predetermined rotation number of the motor and output a stop signal to the motor driving circuit based on a predetermined value of the counter.

3. The nail gun as claimed in claim 2, wherein the nail gun further comprises a pressure ratings option mechanism electrically coupled to the control circuit unit, the pressure ratings option mechanism comprising an adjustment button having at least two pressure ratings;

wherein the adjustment button is configured to select a selected pressure rating of the pressure ratings, the control circuit unit comprises a processing unit capable of receiving a selected signal of the pressure ratings, the control circuit unit is configured to calculate the selected signal into the predetermined rotation number of the motor.

4. The nail gun as claimed in claim 1, wherein the nail gun further comprises a power supply, the control circuit unit and the motor are electrically connected to the power source respectively, and the linear motion actuator is a solenoid valve which comprises a coil electrically connected to the control circuit unit.

5. The adjustable nail gun as claimed in claim 4, the motor is a DC motor, a speed reducer is connected to an output shaft of the motor, a crank is connected to an output shaft of the speed reducer, a connecting rod is connected between the second piston and the crank to form a crank linkage mechanism.

6. The nail gun as claimed in claim 5, wherein the nail gun further comprises a housing, the housing is provided with an inner shell therein, and the pawl is rotatably connected to the inner shell, the pawl comprises an engaging portion and a connection portion integrally connected with the engaging portion, the engaging portion and the connection portion are connected to form an L shape, the engaging portion is provided with a cusp capable of engaging into the recess of the driving ram, the connection portion is provided with an elongated through hole, the solenoid valve further comprises an iron core valve rod inserted inside the coil, and the valve rod is connected inside the through hole of the connection portion.

7. The nail gun as claimed in claim 6, wherein the engaging portion is fixedly connected with a synchronous shaft capable of rotating circumferentially, the engaging portion is located at a first end of the synchronous shaft, a second end of the synchronous shaft is connected with a block, the synchronous shaft is further sleeved with a torsion spring, a first end of the torsion spring acts on the block and a second end of the torsion spring acts on the inner shell.

8. The nail gun as claimed in claim 7, wherein the synchronous shaft is sleeved with a bushing, the bushing is fixed inside the inner shell, and the torsion spring is sleeved on the bushing.

9. The nail gun as claimed in claim 6, wherein the coil is electrically connected to an output end of the control circuit unit, one end of the valve rod extends outside of the coil and is bent and protruded into the through hole, when the coil is energized, the valve rod is capable of moving to drive the cusp of the engaging portion away from the recess of the driving ram.

10. The nail gun as claimed in claim 9, wherein the driving ram is provided with two recesses, the engaging portion is provided with two cusps, and the two cusps are capable of engaging into a corresponding recess of the driving ram.

11. An nail gun, comprising:

a control circuit unit;

a motor electrically coupled and responsive to the control circuit unit;

a first cylinder;

a first piston moveably disposed in the first cylinder and defining a first working chamber with the first cylinder;

a second cylinder;

a second piston moveably disposed in the second cylinder and defining a second working chamber with the second cylinder, the second working chamber communicating with the first working chamber, the second piston capable of being driven by the motor to execute a compression stroke and a return stroke in an operation cycle;

a driving ram fixedly connected with the first piston and the driving ram disposed with a recess;

a pawl capable of engaging in the recess to retain the driving ram and disengaging out of the recess to release the driving ram;

a linear motion actuator electrically coupled to the control circuit unit, the linear motion actuator capable of driving the pawl to retain or release the driving ram; and a delayer electrically coupled to the control circuit unit;

wherein during the compression stroke, the pawl retains the driving ram, and the control circuit unit is configured to calculate a predetermined distance value of the second piston based on a time value of the delayer and control the second piston to move and form a predetermined compressing pressure in the second working chamber;

wherein the delayer is configured to set a time value, during the compression stroke, the pawl retains the driving ram, the control circuit unit is configured to control rotation of the motor and the motor drives the second piston to move a predetermined distance based on the time value of the delayer to form a predetermined compressing pressure in the second working chamber; and wherein the control circuit unit is configured to control the linear motion actuator to release the driving ram when the second piston moves the predetermined distance.

12. The nail gun as claimed in claim 11, wherein the nail gun further comprises a pressure ratings option mechanism electrically coupled to the control circuit unit, the pressure ratings option mechanism comprising a sensor capable of detecting a predetermined point and the delayer capable of set different time values to form at least two pressure ratings in the second working chamber, and the delayer starts timing when the control circuit unit receives a detecting signal from the sensor.

13. The nail gun as claimed in claim 11, wherein the nail gun further comprises a power supply, the control circuit unit and the motor are electrically connected to the power source respectively, and the linear motion actuator is a solenoid valve which comprises a coil electrically connected to the control circuit unit.

14. The nail gun as claimed in claim 11, wherein the control circuit unit comprises a motor driving circuit capable of driving the motor to rotate, and a processing unit capable of receiving a signal of the sensor, the delayer is integrated in the control circuit unit, the control circuit unit is configured to control the delayer for timing and outputting a stop signal to the motor driving circuit based on a predetermined time value of the delayer.

15. The nail gun as claimed in claim 13, wherein the motor is a DC motor, a speed reducer is connected to an output shaft of the motor, a crank is connected to an output shaft of the speed reducer, a connecting rod is connected between the second piston and the crank to form a crank linkage mechanism.

16. The nail gun as claimed in claim 15, wherein the nail gun further comprises a housing, the housing is provided with an inner shell therein, and the pawl is rotatably connected to the inner shell, the pawl comprises an engaging portion and a connection portion integrally connected with the engaging portion, the engaging portion and the connection portion are connected to form an L shape, the engaging portion is provided with a cusp capable of engaging into the recess of the driving ram, the connection portion is provided with an elongated through hole, the solenoid valve further comprises an iron core valve rod inserted inside the coil, and the valve rod is connected inside the through hole of the connection portion.

17. The nail gun as claimed in claim 16, wherein the engaging portion is fixedly connected with a synchronous shaft capable of rotating circumferentially, the engaging portion is located at a first end of the synchronous shaft, a second end of the synchronous shaft is connected with a block, the synchronous shaft is further sleeved with a torsion spring, a first end of the torsion spring acts on the block and a second end of the torsion spring acts on the inner shell.

18. The nail gun as claimed in claim 17, wherein the synchronous shaft is sleeved with a bushing, the bushing is fixed inside the inner shell, and the torsion spring is sleeved on the bushing.

19. The nail gun as claimed in claim 16, wherein the coil is electrically connected to an output end of the control circuit unit, one end of the valve rod extends outside of the coil and is bent and protruded into the through hole, when the coil is energized, the valve rod is capable of moving to drive the cusp of the engaging portion away from the recess of the driving ram.

20. The nail gun as claimed in claim 19, wherein the driving ram is provided with two recesses, the engaging portion is provided with two cusps, and the two cusps are capable of engaging into a corresponding recess of the driving ram.

* * * * *